US005552775A

United States Patent [19]

Harley

[11] Patent Number: 5,552,775

[45] Date of Patent: Sep. 3, 1996

[54] GASEOUS FLUID HANDLING APPARATUS

[75] Inventor: Philip E. Harley, Newcastle-upon-Tyne, United Kingdom

[73] Assignee: Kidde-Fenwal, Inc., Ashland, Mass.

[21] Appl. No.: 232,673

[22] Filed: Apr. 25, 1994

[30] Foreign Application Priority Data

Apr. 30, 1993 [GB] United Kingdom ..... 9308965

[51] Int. Cl.[6] ..... G08B 17/107

[52] U.S. Cl. ..... 340/628; 340/627; 340/630

[58] Field of Search ..... 340/628, 630, 340/627, 632

[56] References Cited

U.S. PATENT DOCUMENTS

| | | | |
|---|---|---|---|
| 3,678,487 | 7/1972 | Ludewig, Jr. et al. | 340/632 |
| 3,952,808 | 4/1976 | Richardson | 340/628 |
| 3,984,826 | 10/1976 | Kowalsky | 340/632 |
| 4,005,754 | 2/1977 | Linden et al. | 340/628 |
| 4,608,556 | 8/1986 | Cole | 340/628 |
| 4,764,758 | 8/1988 | Skala | 340/632 |

FOREIGN PATENT DOCUMENTS 2243475 10/1991 United Kingdom .

*Primary Examiner*—John K. Peng
*Assistant Examiner*—Daniel J. Wu
*Attorney, Agent, or Firm*—Leydig, Voit & Mayer, Ltd.

[57] ABSTRACT

A smoke detecting system monitors smoke from different monitored areas. A main system fan is energized to draw air from all the monitored areas through a smoke detecting unit via individual pipes and via a location unit. When smoke is detected, a control unit produces an indication. In addition, it energizes a sequencing unit which switches off the main fan and then sequentially and individually energizes small fans, each of which draws air through a respective one of the individual pipes and feeds it through the smoke detection unit. When the small fan corresponding to the pipe connected to the particular one of the monitored areas from where the smoke originates is energized, there will be an increase in the output of the smoke detector. This is detected by the control unit which causes the sequencing unit to identify this monitored area on an indicator.

15 Claims, 2 Drawing Sheets

GASEOUS FLUID HANDLING APPARATUS

BACKGROUND OF THE INVENTION

The invention relates to gaseous fluid handling apparatus such as apparatus for handling gaseous fluid containing suspended particles. In an embodiment of the invention to be described in more detail below, the apparatus is incorporated as part of a smoke detecting system which monitors gaseous fluid drawn from a plurality of different locations and checks such fluid for the presence of smoke; if smoke is detected, the apparatus facilitates the identification of the origin of the smoke.

BRIEF SUMMARY OF THE INVENTION

According to the invention, there is provided gaseous flow handling apparatus, comprising a plurality of separate gaseous flow means defining separate gas flow paths, combining means combining the paths into a single outlet path, and a respective individually energizable gas flow producing means in each flow path upstream of the outlet path, whereby to enable any selected one of the flow paths to be connected to the outlet in preference to the other or others.

According to the invention, there is also provided a smoke detecting system for detecting the presence of smoke in any one or more of a predetermined plurality of monitored areas, comprising a plurality of individual gas flow communication means each providing a flow path for gas from a respective one of the monitored areas, combining means connecting all the individual communication means to a common outlet, a smoke detector connected to the common outlet for receiving the gas flow through the common outlet and producing an output signal dependent on the level of smoke in the gas flow therethrough, a main pump operative downstream of the detector for drawing gas through the detector via the outlet simultaneously from all of the individual communication means and thus from all of the monitored areas, and a plurality of individually energizable fans respectively positioned within the individual flow paths and upstream of the combining means, such that each of them when individually energized to the exclusion of the others and when the main pump is unenergised causes gas from the respective one of the monitored areas to be passed through the common outlet and the detector in preference to gas from the other monitored areas.

DESCRIPTION OF THE DRAWINGS

A smoke detecting system embodying the invention will now be described, by way of example only, with reference to the accompanying diagrammatic drawings in which.

DESCRIPTION OF PREFERRED EMBODIMENTS

Figure 1:
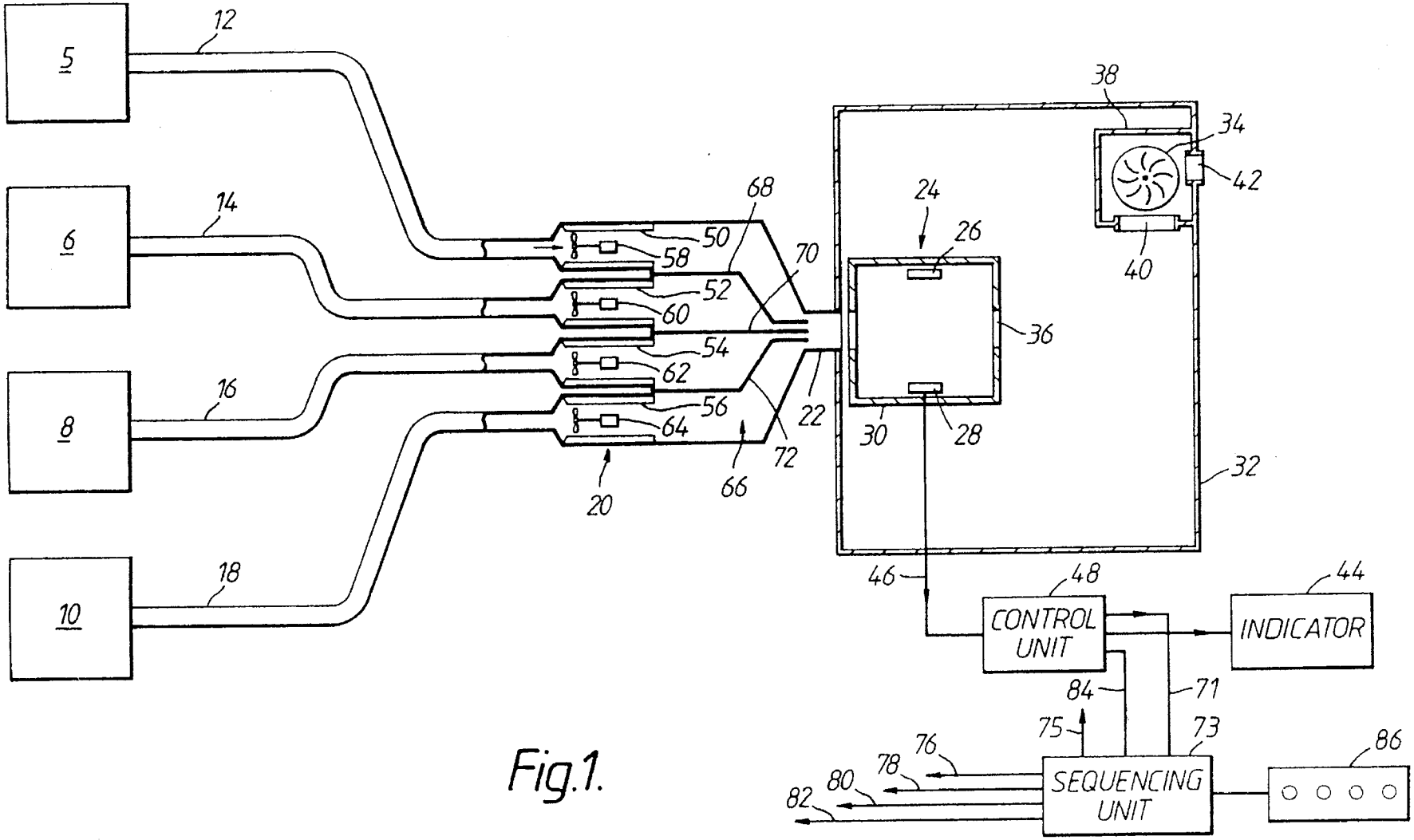
FIG. 1 is a diagrammatic cross-section of one form of the system.

The system of FIG. 1 is for detecting the presence of smoke in air (or other gas) originating from a number of different monitored areas which are indicated purely diagrammatically at 5,6,8 and 10. These monitored areas may be different parts (for example, rooms) of a building, different parts of the same room, different locations within machinery or equipment and the like.

Each of the monitored areas 5 to 10 is connected by a respective pipe 12,14,16 and 18 to a location unit 20 which will be described in more detail below. In a manner to be described, the air from the pipes 12 to 18 passes through the location unit 20 into a common outlet 22 whence it passes into a smoke detecting unit 24.

Smoke detecting unit 24 can take any suitable form. In its simplest form, it comprises an emitter 26 of radiation (such as visible radiation) and a radiation sensor 28 which are positioned on opposite sides of a chamber 30. The chamber 30 is mounted within a larger enclosure 32 which incorporates a main fan 34. The chamber 30 has an opening 36 into the remainder of the enclosure 32. The fan 34 is mounted within a compartment 38 which has an inlet 40 open to the interior of the enclosure 32 and an outlet 42 open to the exterior.

In operation, the fan 34 is energized so as to tend to lower the pressure within the enclosure 32. This pulls air from all the monitored areas 5 to 10, via the respective pipes 12 to 18, through the location unit 20 and its outlet 22 and through the smoke detector unit 24 and thence via the outlet 36 and the inlet 40 and out to atmosphere through the outlet 42.

If any smoke is present in any of the monitored areas 5 to 10, such smoke will be carried by the air flow between the emitter 26 and sensor 28 and will interrupt or reduce the passage of the radiation between them. This reduction or interruption of the radiation will be electrically detected in known manner and produce a "smoke warning" indication on an indicator 44 of any suitable type, the signals being received from the sensor 28 via a connection 46 and processed in a control unit 48.

The smoke detecting unit 24 and its associated circuitry can take any suitable form known to persons skilled in the art. One particular form which the smoke detector can take is disclosed in United Kingdom published Patent Specification No. 2245970 and in the corresponding U.S. application Ser. No. 07/719,125 filed on Jun. 21, 1991 (now U.S. Pat. No. 5,231,378) although any other suitable smoke detector can be used instead.

The system as so far described enables the detection of smoke in the manner explained but the indication produced is simply a generalised smoke indication. It indicates that smoke is present in one (or more than one) of the monitored areas 5 to 10 but gives no indication as to the exact location of the smoke—that is, it does not indicate which one or ones of the monitored areas 5 to 10 contains the smoke. This information is provided in a manner now to be described by the location unit 20.

The location unit 20 comprises a block made of any suitable material in which are formed four cylindrical openings 50,52,54,56, to each of which a respective one of the pipes 12 to 18 is connected. In each of these compartments is mounted a respective barrel-type axial fan 58,60,62 and 64. The compartments 50 to 52 are connected to the outlet 22 by means of a baffle unit 66 containing internal baffles 68,70 and 72 which are indicated only diagrammatically and will be described in more detail with reference to FIG. 2.

During the normal operation of the system described above, the fans 58 to 64 are not energized. As already explained, air is drawn through the system by the main fan 34. During this process, the unenergized small fans 58 to 64 provide substantially no resistance to the flow of air through the system.

However, when smoke is detected (and a resulted indication is given on the indicator 44 as already explained), the control unit 48 produces a control signal on a line 71 to a sequencing unit 73. By means of an output on a line 75, the sequencing unit 73 de-energizes the main fan 34. Then, by means of respective output lines 76,78,80 and 82, it sequentially energises each of the small fans 58 to 64, one at a time; the connections of the lines 75, 76, 78, 80 and 82 to the fans are omitted for clarity.

As each small fan 58 to 64 is energized in the sequence, it will draw air through its respective pipe 12–18 from a respective one of the monitored areas 5–10 and then feed the air through the smoke detector unit 24 and thence through the outlet 42 via the (now stationary) main fan 34. The main fan 34 imposes only minimal resistance to the flow. In this way, the air from each of the monitored areas 5–10 is individually passed through the smoke detecting unit 24 in sequence and the unit 24 tests each such flow of air for the presence of smoke. Therefore, a steep increase in detected smoke level will be produced when the particular one of the small fans 50 to 64 corresponding to the monitored area from where the smoke originates is energized. When such increased smoke level is detected during the sequence, the control unit 48 signals this to the sequencing unit 73 on a line 84 and the sequencing unit 73 energises a second indicating unit 86 via line 88. Indicator unit 86 has four (in this example) indicators and the appropriate one is thus energized to indicate which monitored area 5 to 10 contains the smoke. Clearly, it is possible for the smoke to originate from more than one area and in such a case the system will produce indications on more than one of the indicators.

In practice, initial detection of smoke when the main fan 34 is energized may produce a considerable quantity of smoke in the atmosphere within smoke detector unit 24. In other words, some of this smoke may still be present when the main fan 34 is de-energized and the small fans 58 to 64 are sequentially energized. Nevertheless, when the small fan corresponding to the monitored area from which the smoke originates is energized, there will be a resultant steep increase in the level of smoke detected (even if smoke is still present within the smoke detector unit 24 from the initial energization of the main fan 34). Furthermore, when the small fans corresponding to the monitored areas where there is no smoke are energized, the resultant flow of "clean" air through the smoke detecting unit 24 will produce a significant decrease in detected smoke level. The control unit 48 compares the outputs from the sensor 28 as each of the small fans is energised, in order to identify the monitored area (or areas) from which the smoke originates. The system thus enables identification of the origin of the smoke even where the quantity of smoke being produced is substantial.

The baffles 68,70 and 72 ensure that the energisation of any one of the small fans 58 to 64, and the corresponding flow of air through the baffle unit 66, does not cause such air to flow back through any of the other pipes whose small fans are not at that time energized.

The sequence of operations described, and the functions of the control unit 48 and 73, may be implemented in software. The sequence of operations may be arranged so that, for example, it is temporarily halted if the presence of smoke is detected in a particular monitored area, to allow the corresponding small fan to remain energized for longer than the normal brief period so as to enable a more lengthy test for the presence of smoke to be carried out by the smoke detector unit 24.

In order to improve the speed of detection, the sequencing of fan energization and de-energization can be accelerated by arranging for each of the fans (the small fans and the main fan) to be electrodynamically braked as soon it is de-energized.

The use of the small fans 58 to 64 for identifying the origin of the smoke enables this identification process to be carried out in a very simple manner. Furthermore, it is a fail-safe arrangement in that failure of one of the small fans would not prevent a general indication of the presence of smoke (when the main fan 34 is energized)—although it would of course prevent an indication that the smoke originates from the corresponding monitored area. For the same reason, the small fans 58 to 64 need not be high-reliability items and they thus provide a low-cost arrangement for smoke location.

The use of the small fans does not produce any increase in energy consumption—because the main fan is de-energized when each small fan is energized. There is no overall decrease in long term reliability.

Figure 2:
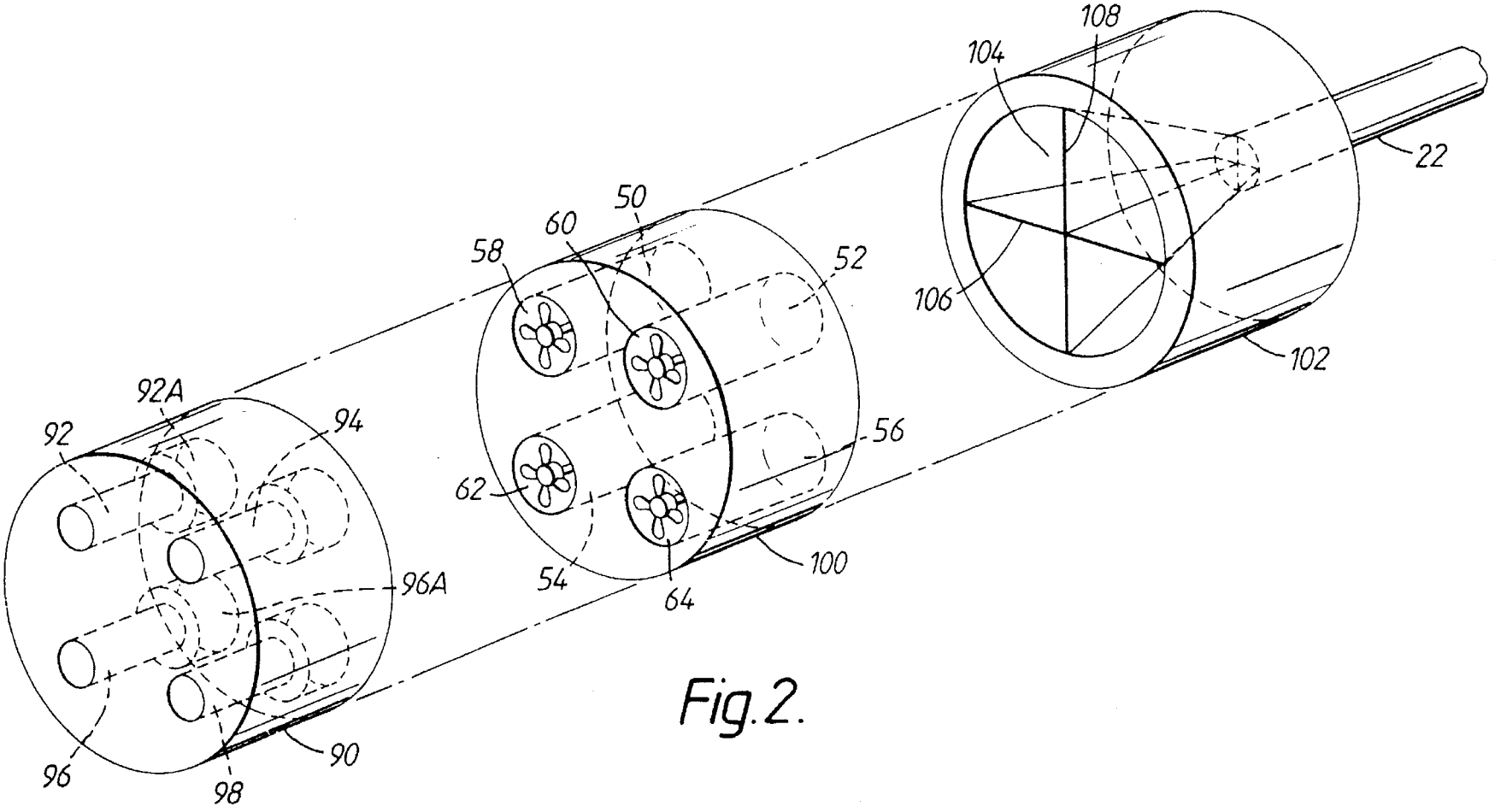
FIG. 2 is an exploded diagrammatic and perspective view of an implementation of part of the system of FIG. 1.

FIG. 2 shows one implementation of the location unit 20 in more detail. As shown in FIG. 2, the location unit 20 is made up of three separate blocks, which can be made of suitable plastics material.

There is an inlet block 90 which is generally in the form of a short-axis cylinder and incorporates four through bores 92,94,96 and 98 each four receiving a respective one of the pipes 12–18. At the output ends, the bores 92 to 98 can be enlarged as shown dotted at 92A and 96A, the corresponding enlargements of the bores 94 and 96 being omitted for clarity.

The small fans 58 to 64 are mounted in the compartments 50 to 56 which are bores formed in a fan block 100 which, again, is in the form of a short-axis cylinder. The compartments 50 to 56 are of course formed so as to match the positions of the outlet ends in the inlet block 90.

Finally, the location unit incorporates a combining block 102 which again is in the form of a short-axis cylinder and has a conically shaped hollow interior 104. The inlet end of this interior is large enough to overlap the open ends of the compartments 50 to 56 in the fan block 100. At its narrow end, it connects with a through bore leading to the outlet pipe 22 (see FIG. 1). The baffles 68,70 and 72 shown in FIG. 1 are implemented in the combining block 102 by two baffle plates 106 and 108 which sub-divide the hollow interior 104 into four regions, each of which is positioned to receive the air from a respective one, only, of the compartments 50 to 56 in the fan block 100. The baffles stop short at the narrow end of the hollow interior 104 so that the smoke from all four regions flows into the outlet 22.

The three units 90,100 and 102 are bolted together by through studs.

It will be understood that the system implementation shown in FIGS. 1 and 2 is merely exemplary. Many modifications may be made to the system. The system may clearly monitor more or less than the four areas shown in FIG. 1, with appropriate modification to the number of small fans and the control system. Where there are more than four monitored areas, a simple sequential polling sequence may not be the most appropriate; a binary succession technique may be more appropriate in certain examples.

Although the arrangement has been described for smoke detection, it may of course be used to detect other contamination such as other particulate contamination, oil mist and the like. In a broader sense, it may be used in other applications where gaseous fluid flows through several pipes and it is desired to be able to select the flow through any one or more of the pipes in preference to the other or others.

What is claimed is:

1. Apparatus for detecting the presence of particles in gaseous fluid derived from a plurality of monitored areas, comprising a plurality of separate gaseous flow means defining separate gas flow paths each having an inlet for receiving gaseous fluid from a respective one of the monitored areas and each having a respective outlet, combining means connected to the outlets of the gas flow paths of the gaseous flow means and combining the paths into a single outlet path, particle detecting means connected to detect the presence of particles in gas flowing in the outlet path and to produce an output signal dependent thereon, main gas flow producing means operative when energized for causing the simultaneous flow of gaseous fluid through all of the separate gas flow paths from the inlets thereof and through the single outlet path to the particle detecting means, a respective individual gas flow producing means located in each flow path between its inlet and its outlet and operative when energized to cause the flow of gaseous fluid from the inlet to the outlet of that flow path and thence through the outlet path and to the particle detecting means, and control means operative, when activated, to selectively and individually energize the individual gas flow producing means while maintaining the main gas flow producing means unenergized, whereby to enable any selected one of the flow paths to be connected to the outlet path in preference to the other or others.

2. Apparatus according to claim 1, in which the control means maintains all the individual gas flow producing means unenergized while the main gas flow producing means is energized, and in which the control means includes sequencing means which is rendered operative when the control means is activated, the sequencing means when rendered operative acting to de-energize the main gas flow producing means and to cause the selective energization of the individual gas flow producing means one at a time in a predetermined sequence.

3. Apparatus according to claim 1, comprising means responsive to detection by the particle detection means of particles in the gas flow through the outlet path when the main gas flow producing means is energized to activate the control means.

4. Apparatus according to claim 1, in which the particles comprise smoke.

5. Apparatus according to claim 1, including means responsive to the output signal from the particle detecting

6. Apparatus according to claim 1, in which each gas flow producing means is an electrically energizable fan. means when a particular one of the individual gas flow producing means is energized to identify the corresponding one of the flow paths as carrying the gaseous flow which includes the particles primarily producing the output signal.

7. A particle detecting system for detecting the presence of particles in at least one of a predetermined plurality of monitored areas, comprising a plurality of individual gas flow means each providing a flow path for gas from a respective one of the monitored areas, combining means connecting all the individual gas flow means to a common outlet, a particle detector connected to the common outlet for receiving the gas flow through the common outlet and producing an output signal dependent on the level of particles in the gas flow therethrough, a main pump mounted downstream of the detector and operative to draw gas through the detector via the outlet simultaneously from all of the individual gas flow means and thus from all of the monitored areas, and a plurality of individually energizable fans respectively positioned within the individual flow paths and upstream of the combining means, such that each of them when individually energized to the exclusion of the others and when the main pump is unenergized causes gas from the respective one of the monitored areas to be passed through the common outlet and the detector in preference to gas from the other monitored areas.

8. A system according to claim 7, including sequencing means for controlling the energization of the pump and the individual fans such that the individual fans are unenergized when the pump is energized, control means responsive to detection of particles by the detector when the pump is energized to cause the sequencing unit to de-energize the pump and to individually energize the fans one at a time according to a predetermined sequence, and means for monitoring changes in the output signal of the detector during the said sequence to identify the monitored area or areas from which the particles originate.

9. A system according to claim 7, in which the combining means includes baffle means for preventing gas flowing in any one of the flow paths when its individual fan is energized from entering any of the other flow paths.

10. A system according to claim 7, in which the main pump is a further fan.

11. A system according to claim 10, in which the particles are smoke.

12. Apparatus for detecting the presence of particles in gaseous fluid derived from a plurality of monitored areas, comprising a plurality of separate gas flow means defining separate gas flow paths each having an inlet for receiving gaseous fluid from a respective one of the monitored areas and each having a respective outlet, combining means connected to the outlet of the gas flow paths of the gaseous flow means and combining the paths into a single outlet path, particle detecting means connected to detect the presence of particles in gaseous fluid flowing in the outlet path and to produce an output signal dependent thereon, a respective individually energizable gas flow pumping means corresponding to and physically located in each flow path between its inlet and its outlet and operative when energized to cause the flow of gaseous fluid from the inlet to the outlet of that flow path and thence to the outlet path and to the particle detecting means, and control means operative, when activated, to selectively and individually energize each of the gas flow pump means in turn and responsive to the output signal from the particle detecting means when each of the gas flow pump means is energized to determine the presence of particles in gaseous fluid received by the corresponding gas flow path.

13. Apparatus according to claim 12, comprising main gas flow producing means operative when energized for causing the simultaneous flow of gaseous fluid through all of the separate gas flow paths from the inlets thereof and through the single outlet path to the particle detecting means, and means responsive to the output signal from the particle detecting means for determining the presence of particles in the gas flowing in the outlet path when the main gas flow producing means is energized and operative in response thereto to activate the control means, the control means when activated de-energizing the main gas flow producing means and maintaining it de-energized while the individual gas flow pump means are selectively and individually energized.

14. Apparatus according to claim 12, in which the individually energizable gas flow pump means are individual fans.

15. Apparatus according to claim 13, in which the main gas flow producing means is a fan.

* * * * *